United States Patent [19]

Haug

[11] Patent Number: 4,898,093

[45] Date of Patent: Feb. 6, 1990

[54] FRANKING MACHINE

[75] Inventor: Werner Haug, Langnau, Switzerland

[73] Assignee: Frama AG, Lauperswil, Switzerland

[21] Appl. No.: 256,070

[22] Filed: Oct. 6, 1988

Related U.S. Application Data

[63] Continuation of Ser. No. 912,401, Sep. 25, 1986, abandoned.

[30] Foreign Application Priority Data

Nov. 12, 1985 [CH] Switzerland ..... 04841/85

[51] Int. Cl.[4] ..... B41L 47/46; B41J 1/34

[52] U.S. Cl. ..... 101/91; 101/110

[58] Field of Search ..... 101/91

[56] References Cited

U.S. PATENT DOCUMENTS

| | | | |
|---|---|---|---|
| 3,643,186 | 2/1972 | Fischer | 335/265 |
| 3,682,378 | 8/1972 | Rouan et al. | 101/91 |
| 3,890,491 | 6/1975 | Malavazos et al. | 101/91 |
| 3,916,785 | 11/1975 | Burger et al. | 101/269 |
| 3,949,330 | 4/1976 | Winter | 335/265 |
| 3,961,298 | 6/1976 | Jaffe et al. | 335/265 |
| 3,965,815 | 6/1976 | Lupkas et al. | 101/110 |
| 4,140,055 | 2/1979 | Lallemand | 101/91 |
| 4,398,458 | 8/1983 | Denzin et al. | 101/91 |
| 4,520,725 | 6/1985 | Haug | 101/45 |
| 4,682,591 | 7/1987 | Pollak, Jr. et al. | 101/91 |

*Primary Examiner*—William Pieprz

*Attorney, Agent, or Firm*—Ladas & Parry

[57] ABSTRACT

The franking value or stamp index wheels mounted in the franking head of the franking machine are adjusted by in each case one pinion, which meshes with the engagement tooth system of a rack. In addition, each rack is provided with a driving tooth system electromagnetically operated by adjusting rams and a retaining tooth system in which engage two retaining pawls. An electromagnetic drive engages and disengages the retaining pawls with the retaining tooth system when the machine main shaft is in the set position. A sensor monitors the engagement movement of the retaining pawls, so that an incorrect position of the racks and therefore an incorrect setting is detectable by the franking machine control unit.

17 Claims, 4 Drawing Sheets

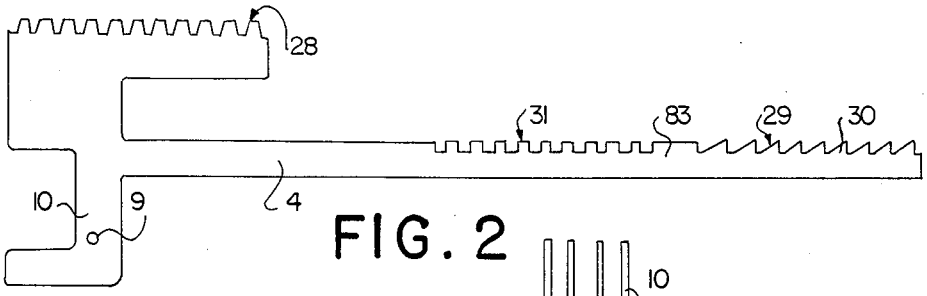
FIG. 2
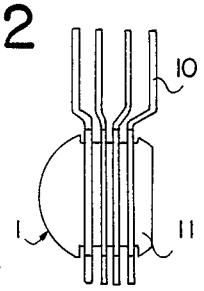
FIG. 4
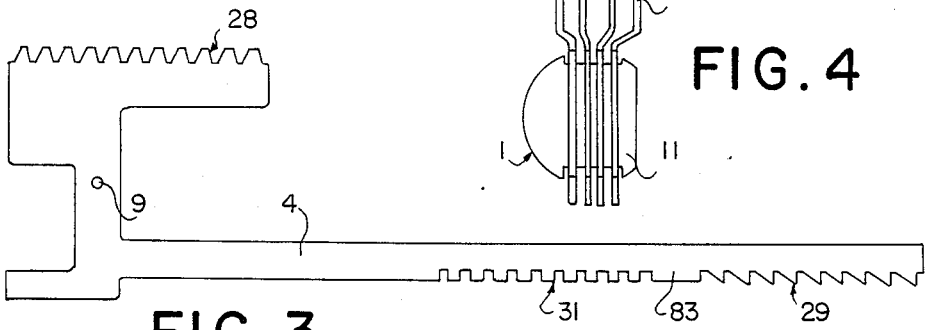
FIG. 3
FIG. 6
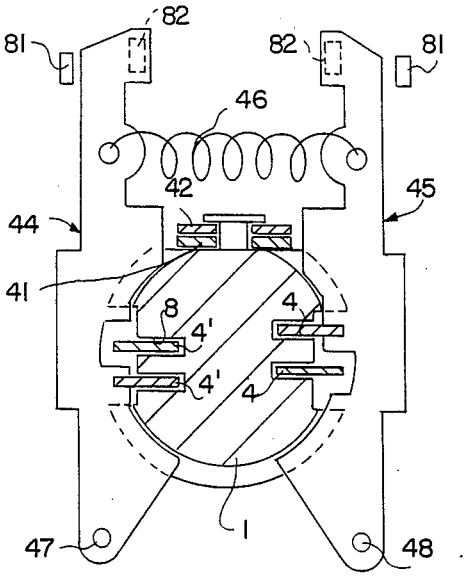
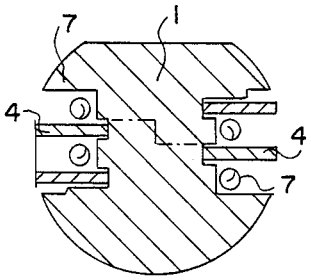
FIG. 5

FRANKING MACHINE

This is a continuation of co-pending application Ser. No. 912,401 filed 9/25/86 now abandoned.

BACKGROUND OF THE INVENTION

The present invention relates to a postage meter (also known as a franking machine) having a franking head fixed to one end of a machine main shaft and in which are adjustably mounted franking value or stamp index wheels. The wheels are in driving connection with a meshing tooth system of racks which are guided in the machine shaft and which additionally have a driving tooth system and a position sensing tooth system. At least one electromagnet engages in each case one adjusting ram with the driving tooth system of a rack and on the driving tooth system of each rack is provided a pawl preventing the rearward movement of the rack. On the position sensing tooth system of the rack there is at least one position sensing pawl additionally securing the adjustment position.

A postage meter or franking machine of this type is known from U.S. Pat No. 4,520,725. A given franking value is set by electromagnetically driven adjusting rams or plungers which move a rack forwards in the direction of the franking head by a number of reciprocating movements corresponding to the numerical value to be set, so that the particular franking value or stamp index wheel of the franking head is set to this numerical value. A pawl is provided for each rack and following each displacement movement of the rack engages behind one of the teeth of its driving tooth system and consequently secures it in the set position where the values of the franking value printing wheels may be permissibly changed by the tension of a return spring. Sensors positioned on the pawls indicate any movement of a pawl over and beyond a tooth of the driving tooth system and into the next tooth space to the electronic display register. Position sensing pawls are also provided which, during franking, engage in an additional position sensing tooth system of the rack and consequently fix the set position of the franking value printing wheels.

In the construction described in the aforementioned U.S. patent, the inhibiting of the displacement movement of a rack due to unauthorized use or manufacturing inaccuracies can lead to the rack return spring not moving back into its initial or neutral position when a new franking value is to be set, so that the new set value is added to a residual value, which does not enter the register for the amounts consumed. If the rack sticks in an intermediate position, then the associated pawl remains on the tip of a tooth of the driving tooth system and the sensor indicates the zero value of the amount count to the register. If the franking machine drive is switched on for franking purposes in such an intermediate position of the rack, damage also occurs to the retaining pawl mechanism, because its cam drive cannot move the retaining pawls into a tooth space of the retaining tooth system.

SUMMARY OF THE INVENTION

Therefore, it is a primary object of the present invention to increase the reliability of a franking machine of the aforementioned type, so that the previously described possibilities of error are eliminated.

In order to implement this and further objects of the invention, which will become apparent as the description proceeds, the invention contemplates a franking machine of the aforementioned type being provided with a position sensing pawl which can be engaged and disengaged with respect to the position sensing tooth system in the setting position of the machine main shaft (i.e., the position in which the postage imprinted by the postage machine may be permissibly changed), and a sensor indicating to the franking control unit the position of the position sensing pawl.

Advantageous embodiments of the invention will become apparent from the following description of the invention with reference to the drawings.

BRIEF DESCRIPTION OF THE DRAWINGS

The invention will be better understood when consideration is given to the following detailed description of a non-limitative embodiment illustrated in the attached drawings, wherein it is shown:

FIGS. 2 and 3: Two racks for setting the stamp index wheels.

FIG. 4: A front view of the end of the machine shaft carrying the franking head with the racks guided therein.

FIG. 5: A cross-section through the machine main shaft in the region between the franking head and the casing partition.

FIG. 6: A cross-section through the machine main shaft along line VI—VI of FIG. 1 with a view of the pawl pair.

DETAILED DESCRIPTION OF THE PREFERRED EMBODIMENTS

As the basic construction of a postage meter or franking machine is known e.g. from numerous machines sold by the Applicant, the drawings are essentially limited to those parts of an inventive machine necessary for the understanding of the present invention.

Figure 1:
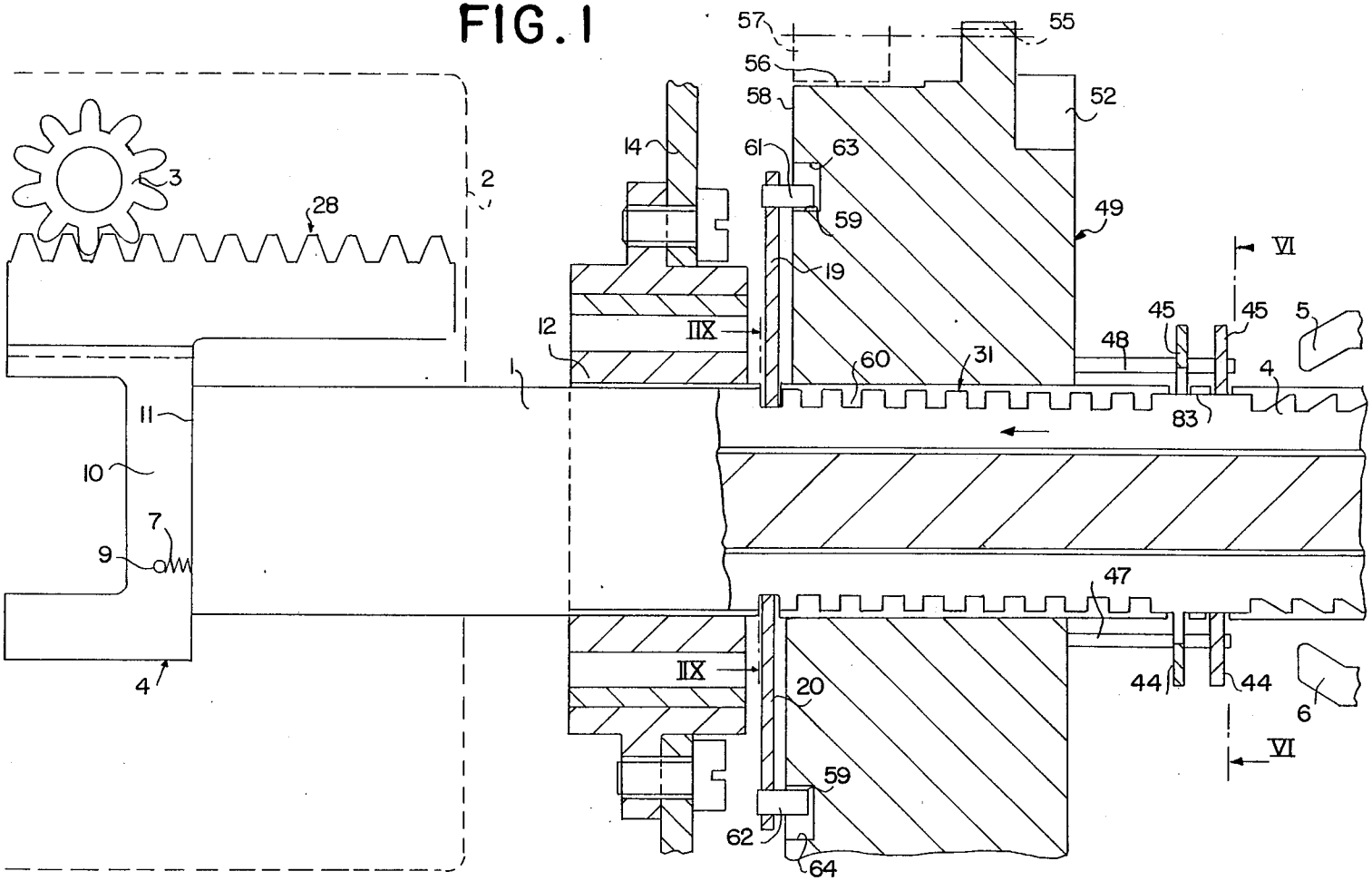
FIG. 1: A diagrammatic partial representation of a franking machine in section along the machine main shaft.

The representation of FIG. 1, which corresponds to FIG. 5 of U.S. Pat. No. 4 520 725, shows a franking head 2, indicated by dotted lines, fixed to the end of the machine main shaft 1. A driving pinion 3 is mounted in said franking head for each franking value printing wheel and fixed thereto. According to the present invention, the pinions are adjustable in a functionally reliable and falsification-proof manner in each case by one rack 4. The racks 4 are moved by electromagnetically driven adjusting rams 5, 6 against the tension of a helical spring 7 and for this purpose are guided in grooves 8, which extend through the machine main shaft 1 as shown in FIGS. 5 and 6. In the neutral or initial position of adjustment movement shown in FIG. 1, the springs 7, which are coupled to a hole 9 on head part 10 of the racks 4 draw the head part 10 of the particular rack against a front face 11 of the machine main shaft 1, said springs being fixed to the latter at an adequate distance from said front face at their other end (not shown). FIG. 4 shows the head parts 10 of four racks 4 in a view of the front face 11 of the machine main shaft 1.

Figure 7:
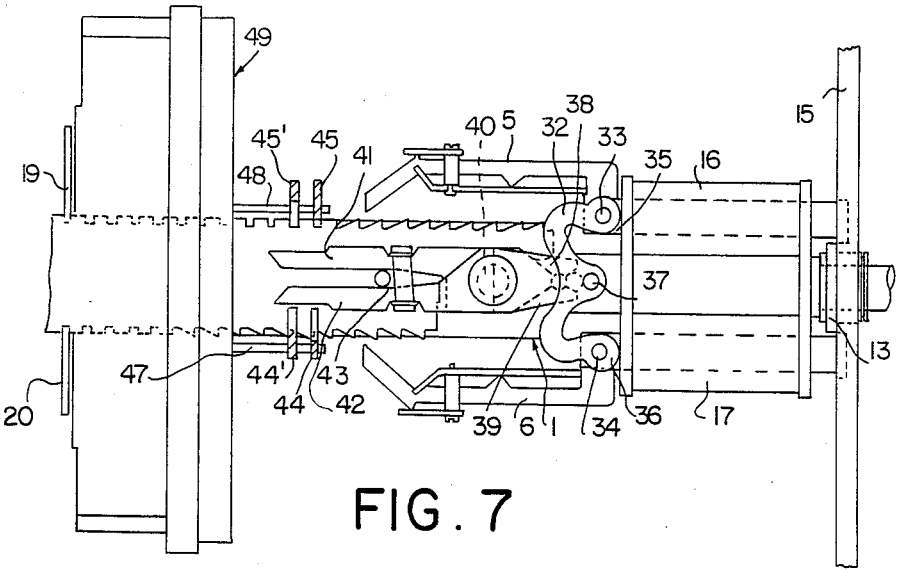
FIG. 7: A diagrammatic view perpendicularly on to the machine main shaft in the vicinity of the adjusting rams with a mechanism for releasing the pawls.

Machine main shaft 1 is mounted by two bearings 12, 13, which are held in two vertically directed inner walls 14, 15 of the machine casing. Adjusting rams 5, 6 with their drive mechanism and electromagnets 16, 17 are held on the inner wall 15 as shown in FIG. 7, whilst the casing inner wall 14 carrying the shaft main bearings 12 carries: a pivot pin 18 (FIGS. 8 and 9) of two position sensing pawls 19, 20, pivot pin 21 of a release lever 22 for position sensing pawls 19, 20, as well as a latch 23, a bearing spindle 24 of gears 25 of the drive system of the machine main shaft 1 and two electromagnets 26, 27 for the pivoting movement of release lever 22 and latch 23. The function of these various elements will be described as the description continues.

As is apparent from the representation of the two racks 4, 4' in FIGS. 2 and 3, apart from a meshing tooth system 28 meshing with one of the pinions 3, each rack has a driving tooth system 29 with sawtooth-like teeth 30 and a position sensing tooth system 31 with a so-called crenelated teeth.

A given amount of postage is set on the stamp index wheels of the franking head 2 by a stepwise displacement of the particular racks 4, 4' by, in each case, one tooth 30, as a result of the jabbing and pushing movement of the adjusting rams 5, 6, as described in U.S. Pat. No. 4,520,725. FIG. 7 only shows the electromagnets 16, 17 bringing about the pushing movement, whilst the electromagnets for the tilting and engagement movement of the adjusting rams 5, 6 are positioned below the aforementioned electromagnets.

According to a preferred embodiment of the invention, the adjusting rams 5, 6 are articulated to a bow-shaped member 32 at pins 33, 34, which in an articulated manner connect the armatures 35, 36 of electromagnets 16, 17 to adjusting rams 5, 6. The bow-shaped member 32 consequently does not prevent the separate adjusting movement of rams 5, 6. However, if both electromagnets 16, 17 are simultaneously supplied with power as a result of the control by a franking machine control unit, member 32 moves in the direction of the machine main shaft 1 and forces a bolt 37 fixed in its centre into a V-shaped gap, indicated by dotted lines, between the shorter legs 38, 39 of two spreading or expanding legs 41, 42. Legs 41, 42 in a scissor-like manner at a joint bolt 40, so that legs 41, 42 spread apart counter to the tension of a spring 43 connecting them, when bolt 37 interacts with the V-shaped gap. This spreading action disengages the pawls 44, 44', 45, 45' from its associated rack 4, 4'. As can be seen from FIG. 6, pawls 44, 44', 45, 45' can be pivoted about axle journals 47, 48 counter to the tension of a spring 46, which tends to move them into engagement. The journals 47, 48 are fixed to a control wheel 49 carried by the machine main shaft 1, so that they rotate with the latter. In the case of a separate adjusting movement of one of the adjusting rams 5, 6, the bow-shaped member 32 rotates about pin 33 or 34 of the stationary adjusting ram and bolt 37 is only moved by half its maximum possible path between the shorter legs 38, 39, without exerting a force thereon. Thus, in its initial position, bolt 37 is at a corresponding distance from legs 38, 39, so that only in the case of the simultaneous activation of the two electromagnets 16, 17 is there a spreading apart of the spreading legs.

Control wheel 49 fixes the set position of main shaft 1, so that the racks with their driving tooth system 29 are precisely located below the adjusting rams 5, 6. For this purpose a roller 51 mounted at one end of a lever 50 presses into a recess 52 on the circumference of control wheel 49. In the setting position, latch 23 with its hook part 53 engages in a depression 54 of control wheel 49, so that rotation of the machine main shaft 1 for franking is only possible after an electromagnet 27 has pivoted back latch 23 from its latched position. As soon as depression 54 has passed hook part 53 as a result of rotation of the machine main shaft 1, the set franking value is added to the consumption storage means of the franking machine. Turning the shaft backwards is prevented by the step 90 following depression 54 in the path 91 on which hook part 53 slides during rotation of main shaft 1. A further hook-like step 92 in path 91 prevents a manual rotation to and fro of franking head 2 in its printing position for multiple printing purposes.

Turning again to FIG 1, a driving tooth system 55 and a control path 56 are also provided on the circumference of the control wheel 49. On control path 56 rolls a control roller 57, which controls the pressing movement of a pressure roller, which presses a letter to be franked against the printing block with the index wheels.

A control groove 59 is provided in the front face 58 facing franking head 2 of the e.g. plastic, solid control wheel 49 and during the rotation of machine main shaft 1 said groove 59 ensures the engagement of the position sensing pawls 18, 19 in a space or crenel 60 of the position sensing tooth system 31 of racks 4, 4' by guiding control bolts 61, 62 provided on position sensing pawls 18, 19. In the rotation position of control wheel 49 corresponding to the setting position of machine main shaft 1, in the vicinity of control bolts 61, 62, control groove 59 is provided with a radially outwardly directed widened portion 63, 64 for each control bolt 61, 62. These widened portions 63, 64 make it possible to open the tong-like retaining pawls 19, 20 embracing the machine main shaft 1, so that they release racks 4, 4' for setting the index wheels. An electromagnet 26 opens the retaining pawls 19, 20 against the tension of a tension spring 65.

Figure 9:
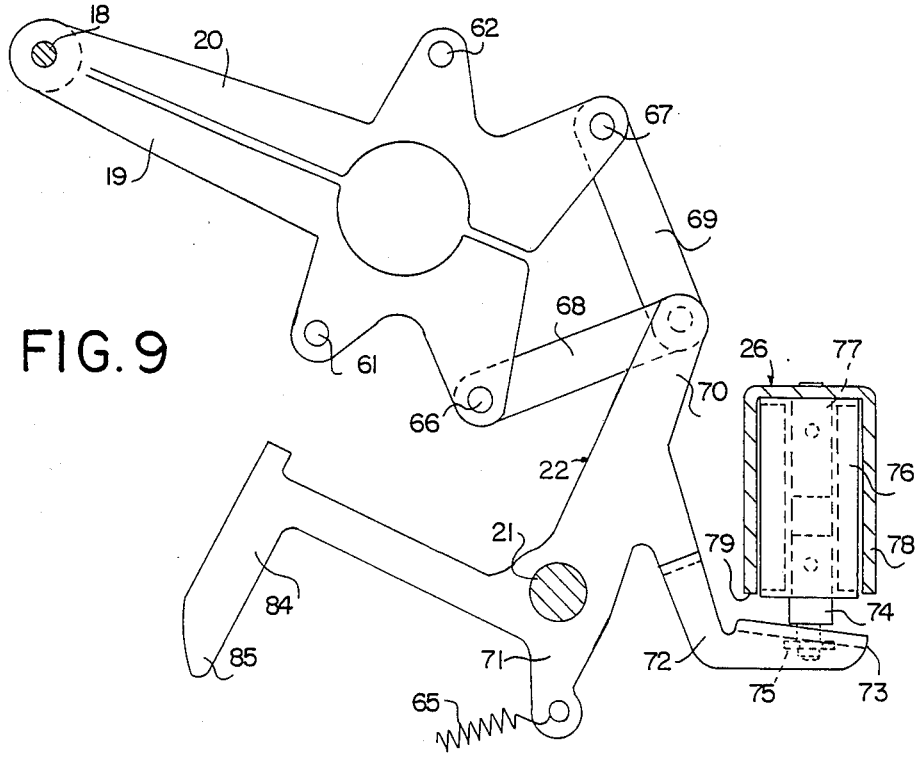
FIG. 9: A separate representation of the position sensing pawl mechanism with a different scale of reproduction.

An example for a suitable lever mechanism for retaining and releasing racks 4, 4' by the pivoting movement of pawls 19, 20 about pivot pin 18 is shown in FIG. 9. The outer ends of pawls 19, 20 are connected by in each case one joint 66, 67 and in each case one arm 68, 69 to one end 70 of a release lever 22 which, as depicted has four arms. The pivoting movement of lever end 70 due to the pivoting movement of release lever 22 in the direction of pawls 19, 20 resulting from the supply of power to electromagnet 26, consequently spreads apart pawls 19, 20. Tension spring 65, acting against the force of the electromagnet on lever arm 71, once again closes the position sensing pawls 19, 20 in engagement with a gap 60 of the retaining tooth systems 31. Lever arm 72, on which acts electromagnet 26, is provided at its end with a plate 73, which forms a hinged armature. In addition, a tension or pull armature shank 74 of electromagnet 26 engages through an opening 75 of the hinged armature plate 73 and grips behind the same, so that electromagnet 26 acts both with a pull armature 74 and a hinged armature and consequently there is a high holding power compared with the voltage to be used. Only 9 V are required instead of 42 V when using a pull armature magnet, so that the energy expenditure for keeping the retaining pawls in the spread-apart position against the tension of spring 65 is advantageously low. Over roughly half its length, the winding 76 of electromagnet 26 preferably surrounds an iron core 77, so that the pull armature 74 is drawn against said iron core 77. In addition, electromagnet 26 has a magnetically acting iron core 78 against whose front face 79 engages the hinged armature plate 73.

Engagement or closing the position sensing pawls 19, 20 through the tension of spring 65 closing of the said pawls 19, 20 is only possible if the racks for setting the stamp index wheels are advanced by a full pitch distance of the driving tooth system 29 and therefore also the position sensing tooth system 31 are located precisely in the neutral position shown in FIG. 1. According to the present invention, the movement of the position sensing pawls is indicated by a sensor to the franking machine control unit, so that franking in the case of incorrectly set racks 4, 4' is not possible. In such a position, one or more pawls 44, 44', 45, 45' would be located on the tip of one of the teeth 30 of the driving tooth system 29, i.e. would be in an outwardly pivoted position (FIG. 6), so that their associated sensors 81, 82 would indicate to the franking machine counter a zero value position of the rack or the associated stamp index wheel, because in the actual zero value position pawls 44, 44', 45, 45' are also in an outwardly pivoted position on the toothless part 83 of rack 4, 4', as shwon in FIG. 1. Thus, sensors 81, 82 cannot distinguish between an incorrect position and a zero value position of racks 4, 4' or the retaining pawls. However, this is possible through sensor 80, which indicates whether 4, 4' is in a correct position.

In the represented embodiment of the invention sensor 80 (FIG. 8) is operated by a signal arm 84 of release lever 22, through its end 85 moving into the switching zone of sensor 80, which is e.g. constructed as a photoelectric cell, if pawls 19, 20 pivot outwards.

Preferably sensor 80 indicates or confirms the complete performance of each individual stepwise control movement for the pawls, together with sensors 81, 82, to the franking machine control unit, so that the position sensing pawls 19, 20 open and close together with each control movement of adjusting rams 5, 6, in that electromagnet 26 is supplied with power with the same pulse train as electromagnets 16, 17 for setting a digit of a franking value index wheel. For setting the digit "3", the particular electromagnet 16 or 17 and electromagnet 26 consequently successively receive three current pulses. Apart from confirming the adjusting movement of racks 4, 4' through the engagement movement of position sensing pawls 19, 20 in a space or crenel 60 of the position sensing tooth system 31, the particular engagement of position sensing pawls 19, 20 also ensures that the rack adjustment is performed by an adjusting ram 5, 6, so that racks 4, 4' cannot be retracted by their associated return spring 7 into the neutral position if the pawls 44, 44', 45, 45' associated therewith jump out of their locking position in the driving tooth system 29 due to powerful franking machine vibrations. Position sensing pawls 19, 20 also prevent adjustment from the outside of the index wheels or racks by manipulations performed on the franking head 2.

Figure 8:
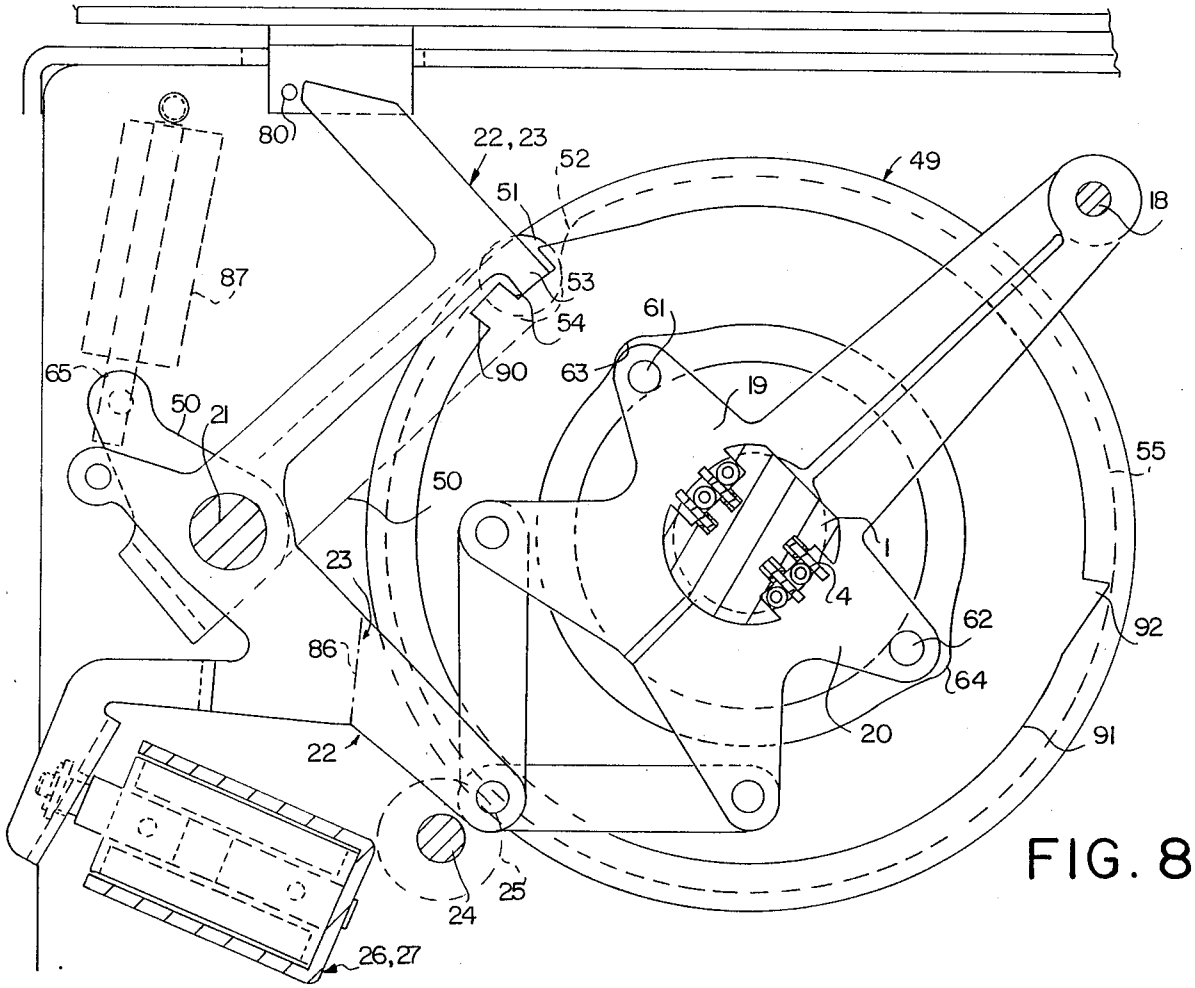
FIG. 8: A view of the position sensing pawl mechanism with a section through the machine main shaft along line IIX—IIX in FIG. 1.

In order to simplify manufacture, the release lever 22 for the position sensing pawls 19, 20 and latch 23 engaging in the depression 54 on the circumference of control wheel 49 are stamped or punched as sheet metal parts using the same tool, so that the release lever 22 completely covers the latch 23 in FIG. 8. In FIG. 8, electromagnets 26, 27 and the tension springs 65 acting on said levers 22, 23 also cover one another. Latch 23 is modified with respect to release lever 22 by cutting away lever end 70 along the broken line 86, because this would hinder its movement. In addition, release lever 22 and latch 23 partly cover lever 50 carrying roller 51. As a result of the stronger spring 87, lever 50 is pressed about the common pivot pin 21 against control wheel 49.

What is claimed is:

1. A franking machine of the type having a control unit, said machine comprising: a franking head (2) fixed to one end of a main shaft (1) of said machine, franking value printing wheels (3) mounted in said head and which mesh with a meshing tooth system (28) of racks (4) guided in the main shaft (1) and which, in addition to the meshing tooth system (28), have a driving tooth system (29) and a position sensing tooth system (31), electromagnets (16, 17) being provided to move an associated driving push rod (5, 6) into engagement with the driving tooth system 29 of one of said racks (4), retaining pawls (44, 44', 45, 45') provided to prevent the rearward movement of said racks and at least one position sensing pawl (19, 20) provided to sense, by engagement into the position sensing tooth system, the correct position thereof, wherein the position sensing pawl (19, 20) is linked to an electromagnet (26) to be engaged and disengaged with respect to the position sensing tooth system in a position of the main shaft (1) in which the printing wheels (3) are adjusted, a sensor (80) indicating to the control unit the position of said position sensing pawl (19, 20) said engagement and disengagement of said position sensing pawl occuring while said main shaft is at rest.

2. A franking machine according to claim 1 wherein the position sensing pawls (19, 20) embrace the main shaft (1) and during the franking action of the latter are kept engaged with the position sensing tooth system (31) by means of control elements (61, 62) riding in a control path (59) of a control wheel (49), wherein the position sensing pawls (19, 20) are pivotable by said electromagnet (26) against the tension of a spring (65) in said position of the machine main shaft (1) in which the printing wheels (3) are adjusted.

3. A franking machine according to claim 2, wherein the position sensing pawls are connected in articulated manner by in each case one arm to a multi-arm release lever, the pull armature of the electromagnet being fixed to one lever arm of the release lever.

4. A franking machine according to claim 2, wherein the release lever has a signal arm, in whose pivoting range is provided said sensor.

5. A franking machine according to claim 1, wherein the movement of the at least one position sensing pawl is controlled synchronously with the movement of the driving push rods.

6. A franking machine according to claim 1, wherein said sensor indicates the neutral position of said racks to the franking machine control unit, after all retaining pawls have been moved out of engagement with the driving tooth system by a release mechanism.

7. A franking machine according to claim 1, wherein a release mechanism is provided for moving all the retaining pawls out of engagement with the driving tooth system, which is provided with a bow-shaped member connecting in articulated manner two of the push rods, so that through the simultaneous power supply to the electromagnets provided to move an associated driving push rod, said bow-shaped member engages spreading elements arranged between said retaining pawls.

8. A franking machine according to claim 7, wherein the spreading elements are formed by two spreading legs, which are pivotably mounted in scissor-like manner about a joint bolt fixed to the machine main shaft, a spreading member fixed to the bow-shaped member being movable into the spread-out position between said spreading legs.

9. The franking machine of according to claim 1, wherein said electromagnetically driven push rods have two push rods, a bow-shaped member articulated to the two push rods, each push rod having its own electromagnet so that thruogh the simultaneous application of power to two electromagnets said bow-shaped member engages spreading elements arranged between the retaining pawls so as to move them away from their associated rack.

10. The franking machine according to claim 9, wherein the spreading elements are formed by two spreading legs which are pivotally mounted together in a scissor-like manner, the bow-shaped member being movable into and out of engagement with one end of said spreading elements.

11. A postage franking machine of the type having a control unit, said franking machine comprising: a main shaft; a franking head fixed to said main shaft; franking value printing wheels mounted on said franking head; racks disposed longitudinally of the main shaft, each one of said racks having a meshing tooth system for engaging with an associated printing wheel, a driving tooth system and a position sensing tooth system; electromagnetically driven push rods for engagement with the driving tooth system of said racks; electromagnetically operated retaining pawls disposed to selectively prevent the rearward movement of said racks; at least one position sensing pawl disposed for engagement into the position sensing tooth system; means for engaging and disengaging the at least one position sensing pawl from said position sensing tooth system when main shaft is in a position in which the printing wheels are adjusted said engagement and disengagement of said position sensing pawl occuring while said main shaft is at rest; and a sensor responsive to the position of said position sensing pawl for providing a sensing signal to the control unit.

12. The franking machine as claimed in claim 11, further including a control wheel having a control path therein and wherein said position sensing pawls include control elements which ride in said control path, said position sensing pawls embracing the main shaft and which, during the franking action of the latter, are kept in engagement with the position sensing tooth system by means of said control elements riding in said control path.

13. The franking machine of claim 12, wherein said means for engaging and disengaging include a spring for urging said position sensing pawls into engagement with said main shaft and electromagnetic means for urging said position sensing pawls out of engagement with said position sensing tooth system.

14. The franking machine according to claim 13, wherein the position sensing pawls are articulated to each other and further including a multi-armed release lever which is articulated to said position sensing pawls and to said electromagnetic means.

15. The franking machine according to claim 14, wherein said multi-armed lever includes a signal arm whose pivoting range is within the range of said sensor.

16. The franking machine according to claim 11, wherein the movement of at least one of the position sensing pawls is controlled synchronously with the movement of said driving push rod.

17. The franking machine of claim 11, wherein said sensor indicates a neutral position of the racks to said control unit when all retaining pawls have been moved out of engagement with the driving tooth system.

* * * * *